United States Patent [19]

Kimes

[11] Patent Number: 4,882,791

[45] Date of Patent: Nov. 28, 1989

[54] TOILET FOR DISABLED PERSONS

[76] Inventor: Robert H. Kimes, Hickory Hill, Freeport, Ill. 60132

[21] Appl. No.: 333,687

[22] Filed: Apr. 5, 1989

[51] Int. Cl.[4] ..... E03D 11/00

[52] U.S. Cl. ..... 4/254; 4/420; 4/252 R; 4/661

[58] Field of Search ..... 4/254, 252 R, 661, 4/420, 420.3, 421, 425, 429, 430, 443, 445, 446, 450, 455, 420.4, 480, 471

[56] References Cited

U.S. PATENT DOCUMENTS

| | | | |
|---|---|---|---|
| 2,774,975 | 12/1956 | Frank | 4/254 |
| 3,619,820 | 11/1971 | Cain et al. | 4/254 |
| 4,144,597 | 3/1979 | Guenther et al. | 4/254 |
| 4,685,157 | 8/1987 | James | 4/254 |
| 4,715,069 | 12/1987 | James | 4/254 |
| 4,794,653 | 1/1989 | Strosser | 4/252 R |

*Primary Examiner*—Henry K. Artis

*Attorney, Agent, or Firm*—McCaleb, Lucas & Burgman

[57] ABSTRACT

A toilet for the disabled, particularly the wheelchair bound, spinal cord injured person in which the toilet bowl is formed with recesses along the top margins of its side walls to permit hand insertion for carrying out perineal cleaning functions. The combined height of the toilet bowl and seat in conjunction with optional handrails serve to promote user transfer from a wheelchair.

8 Claims, 3 Drawing Sheets

TOILET FOR DISABLED PERSONS

This invention relates generally to sanitation equipment, specifically toilets for use by disabled humans.

BACKGROUND OF THE INVENTION

Existing and known toilet facilities for the disabled are generally unsatisfactory in that they do not accommodate perineal cleaning by the disabled user, particularly spinal cord injured persons who have little or no leg use and are unable to raise up from the seat to carry out such functions. In addition, existing governmental standards for the height of the toilet bowl makes it difficult for the wheelchair disabled to adequately transfer between the wheelchair and toilet seats. Similarly, existing governmental regulations for a wall mounted grab bar locate the bar at a height that is out of reach to the normal wheelchair user; thereby preventing the application of adequate transfer leverage by a disabled person with limited upper body strength.

In view of the above-noted shortcomings of heretofore known toilet facilities for the disabled, the present invention provides an improved structure which overcomes such prior defects.

BRIEF SUMMARY OF THE INVENTION

The improved toilet structure of this invention comprises a ground engaging or wall mounted toilet bowl dimensioned to locate the top of the bowl with attached seat at a level substantially co-planar with the seat of a wheelchair to facilitate transfer of the disabled user between a wheelchair and the toilet seat. More importantly the upper edge margins of the toilet bowl are formed with vertically recessed areas to provide entryways of sufficient size to accommodate easy passage of the user's hand, wrist, and forearm thereby permitting the user to reach beneath the toilet seat, through at least one side of the toilet bowl to facilitate perineal cleaning functions. A unitary arm rest, attached to the toilet structure is provided at a location which is conveniently accessible to the user thereby providing manually engageable means to assist in transfer movements between the toilet and wheelchair seats.

It is an important object of this invention to provide an improved toilet structure for use by disabled persons, particularly those who are wheelchair bound, which affords easy perineum access to the user without the necessity of raising from the toilet seat.

It is a further important object of this invention to provide an improved toilet structure for the disabled, which is constructed and arranged to promote easy transfer of the disabled person between the toilet seat and a wheelchair.

Another important object of this invention is to provide an improved toilet/water closet structure for the disabled which incorporates arm rest means arranged to provide convenient engagement by a wheelchair user to assist in transfer movements between the toilet and wheelchair.

Having described this invention, the above and further objects, features and advantages thereof will be recognized by those familiar with the art from the following detailed description of a preferred embodiment of the invention illustrated in the accompanying drawings and representing the best mode presently contemplated for enabling those skilled in the art to carry out this invention.

IN THE DRAWINGS

DESCRIPTION OF THE PREFERRED EMBODIMENT

Figure 1:
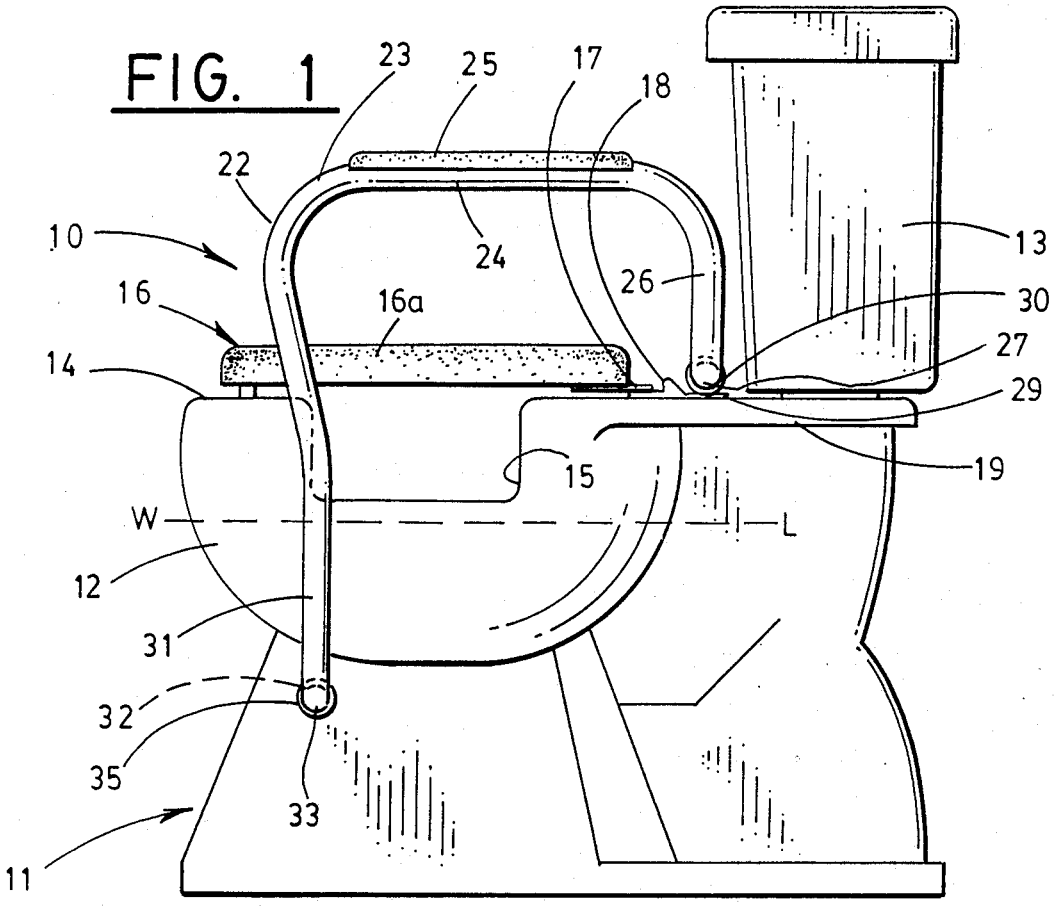
FIG. 1 is a side elevational view of a floor mounted toilet for the disabled according to this invention.
Figure 2:
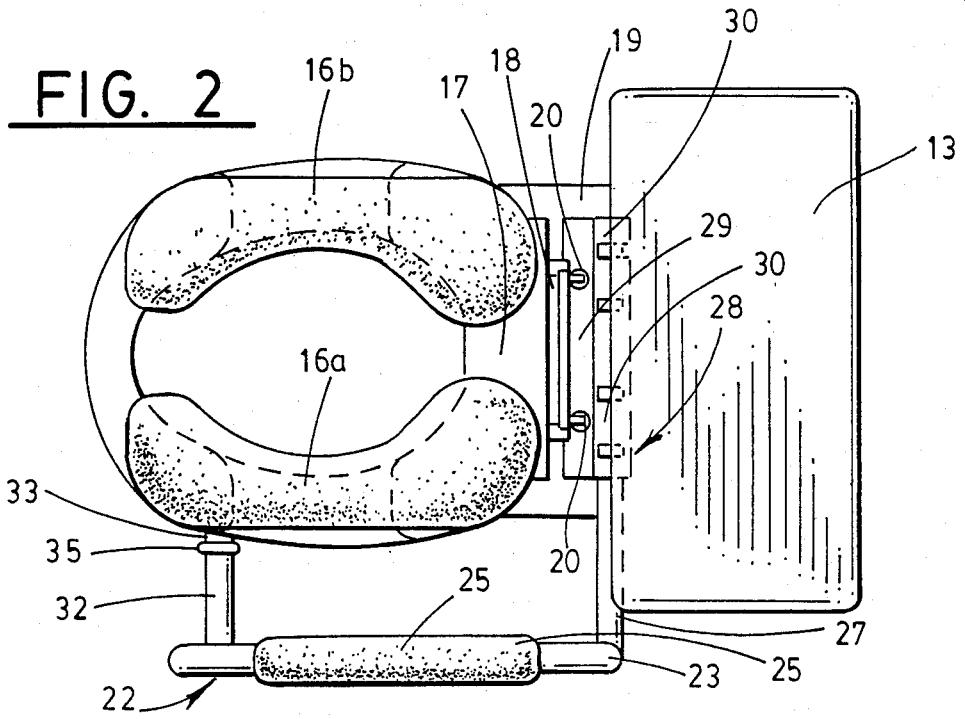
FIG. 2 is a top plan thereof.
Figure 3:
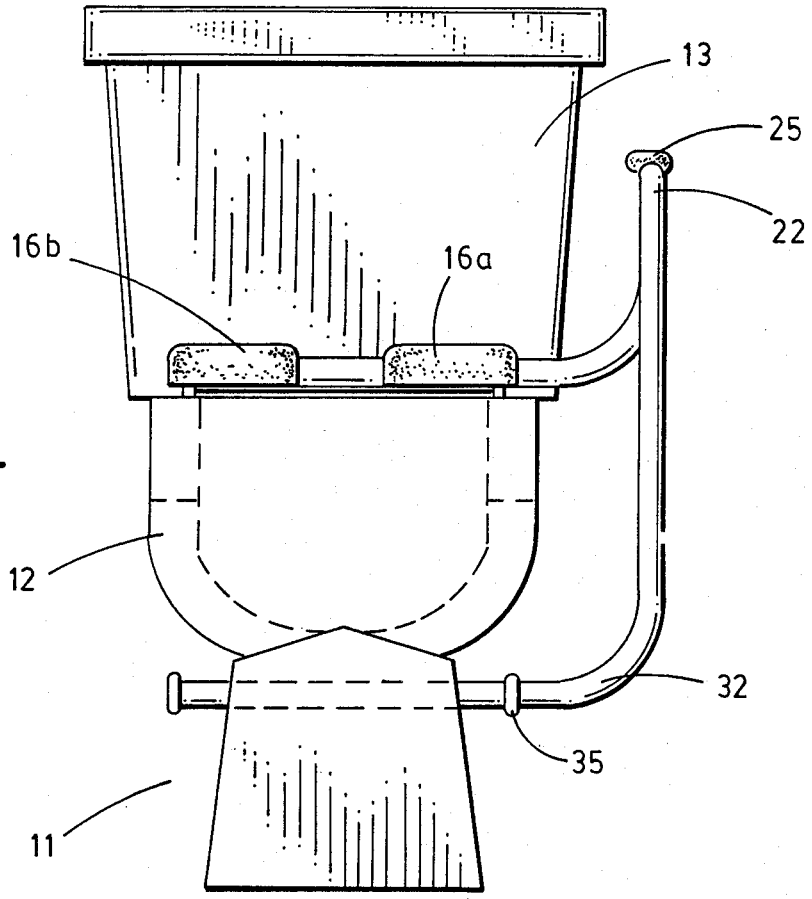
FIG. 3 is a front elevation thereof.

Turning now to the drawings, FIGS. 1–3 set forth the features of a floor mounted toilet assembly for the disabled according to this invention.

As therein illustrated a toilet assembly 10 comprises an elongated cast ceramic structure having a floor engaging base/pedestal portion 11 supporting an integral water or toilet bowl portion 12 and a water closet 13 which is shown as a detachable vessel, normally bolted atop the base/pedestal in known fashion. In other instances the water closet 13 may be formed as an integral part of the base pedestal according to recognized practice.

In the usual or standard floor mounted toilet the upper rim 14 of the toilet bowl is located approximately 15 inches from the floor. In the preferred form of floor mounted toilet 10 shown in FIG. 1, such floor to bowl rim distance preferably is raised to a distance in the order of 18 inches, which better accommodates mounting and dismounting of the toilet by a wheelchair bound user, as will be amplified in greater detail presently.

Aside from the noted height difference, bowl portion 12 is further distinguished by a pair of diametrically opposed, lateral openings or recesses 15, one on each side of bowl 12, which extend downwardly from rim 14 and are located substantially medially of the bowl's front to back dimension. The depth and length of each opening 15 is such as to accommodate the user's hand, wrist and part of his forearm for access to the perineum. Typically in a 18 inch high bowl, as noted above, rectangular openings 15, as shown, are substantially 4 inches deep and 8 inches long as viewed in FIG. 1, although these dimensions obviously may vary depending on design parameters. In any event, openings 15 must be of sufficient size, shape and location to afford the disabled user ready lateral access and passageway to the perineum. Importantly, of course, the lower reaches of openings 15 must be maintained above the water level in bowl 12, designated W-L in FIG. 1.

Disposed over the rim 14 of the toilet bowl portion is a pivotally mounted toilet seat 16, shown herein as comprising a pair of padded arcuate sections **16*a* and 16*b* which are joined at their rearward ends by a transverse planar tie plate 17 (see FIG. 2). The tie plate is secured to a hinge assembly 18 joined t a horizontal platform 19 of the pedestal 11, rearwardly of the toilet bowl 12, by conventional hold down bolts 20, 20**.

With the 18 inch high bowl rim 14, as herein described, seat 16 preferably is of a thickness to locate its upper surface substantially 20 inches from the floor. This seat height generally matches the height of a conventional padded seat used on wheelchairs. Consequently, with the toilet seat height substantially co-planar with the level of the wheelchair seat the user is greatly assisted in making an easy transfer between such seats.

To complete the toilet assembly 10, at least one and preferably two integral arm supports 22, 22 are provided, one on each side of the toilet bowl 12. Each arm support comprises an integral, one piece substantially U-shaped support tube, such as 1 inch 0.0 aluminum tubing, suitably bent and formed to provide a horizontal reach 24 over which is mounted a padded arm rest 25. Reach portion 24 is joined at one end to a vertical rear support leg 26 that is integral with a right angularly related inwardly turned mounting arm portion 27. (see FIGS. 2 and 3) Such arm portion is adapted to be received in support bracket 28 having a planar base plate 29 secured to the platform 19 by means of the hold down bolts 20, 20 for the seat hinge assembly 18. Tubular member 30, fixed to plate 29, coaxially receives the outer end of mounting arm portion 27 therewithin. A compression fitting, pins or like fastener members (not shown) serve to secure portion 27 against axial displacement in tube 30.

At the forward end of the horizontal reach 24, the support tube is suitably beat downwardly to provide a front support leg 31 which extends vertically and merges into an inwardly turned horizontal front mounting arm 32. The outer end of arm 32 fits coaxially within a tubular mounting sleeve 33 extending horizontally through an opening 34 formed in the cast pedestal/base 11. A compression fitting 35 serves to lock arm 32 in sleeve 33 (see FIG. 1).

While the illustrated floor mounted assembly 10 shows only one arm support 22, it is to be understood that a second such support may be added, if desired, as shown in a wall mounted version of the toilet assembly, as will now be described.

Figure 4:
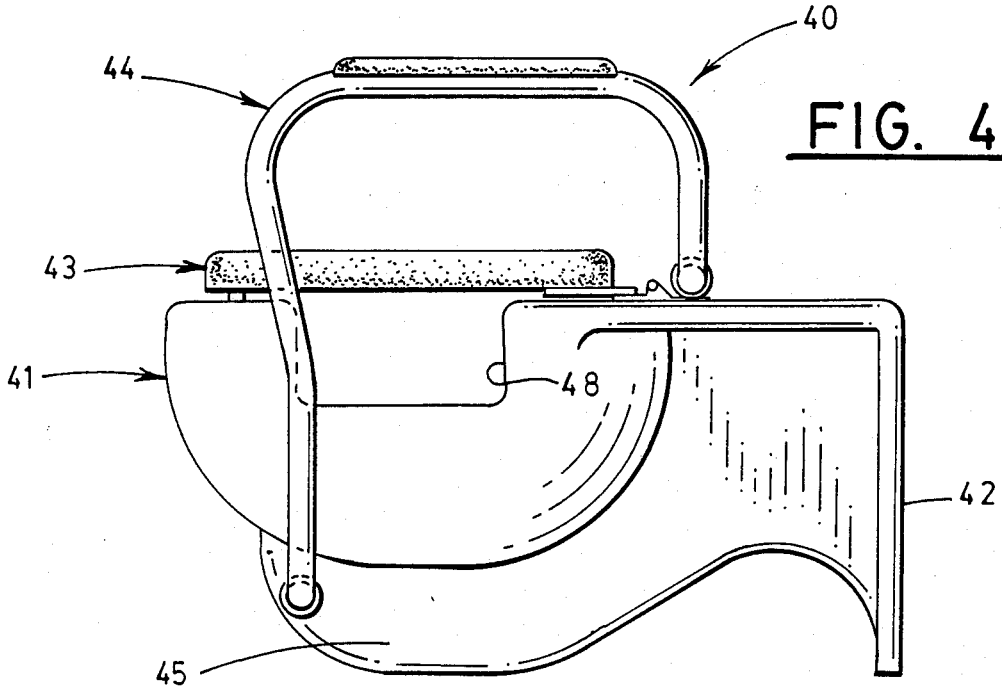
FIG. 4 is a side elevation of a wall mounted toilet in accordance with this invention.
Figure 5:
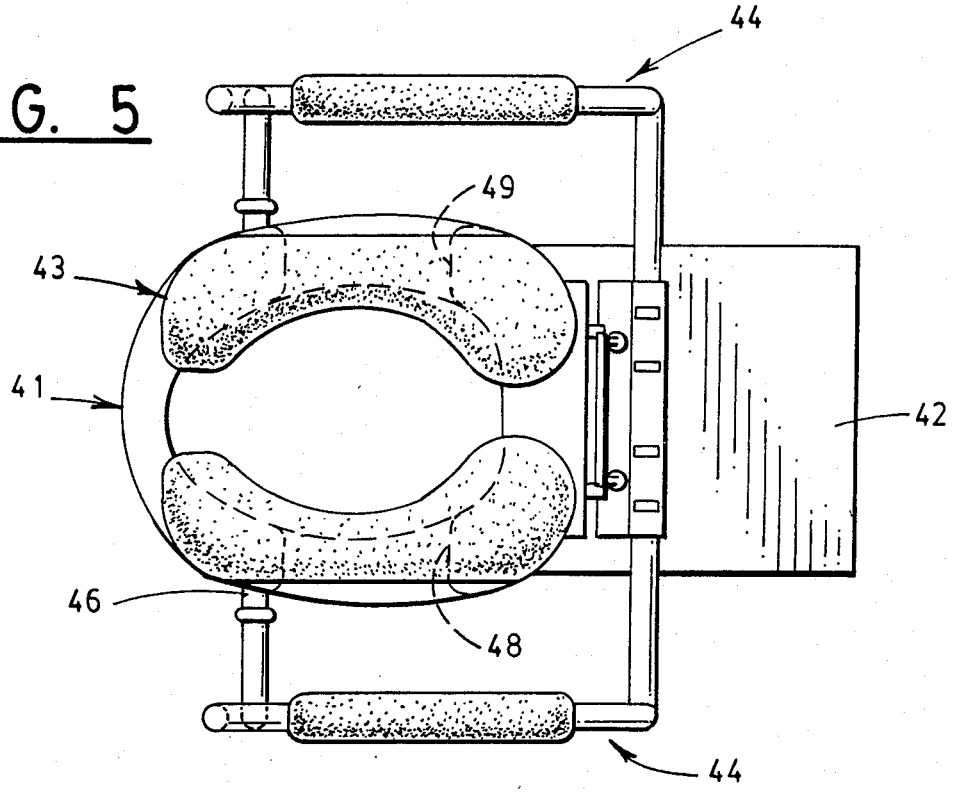
FIG. 5 is a top plan thereof.
Figure 6:
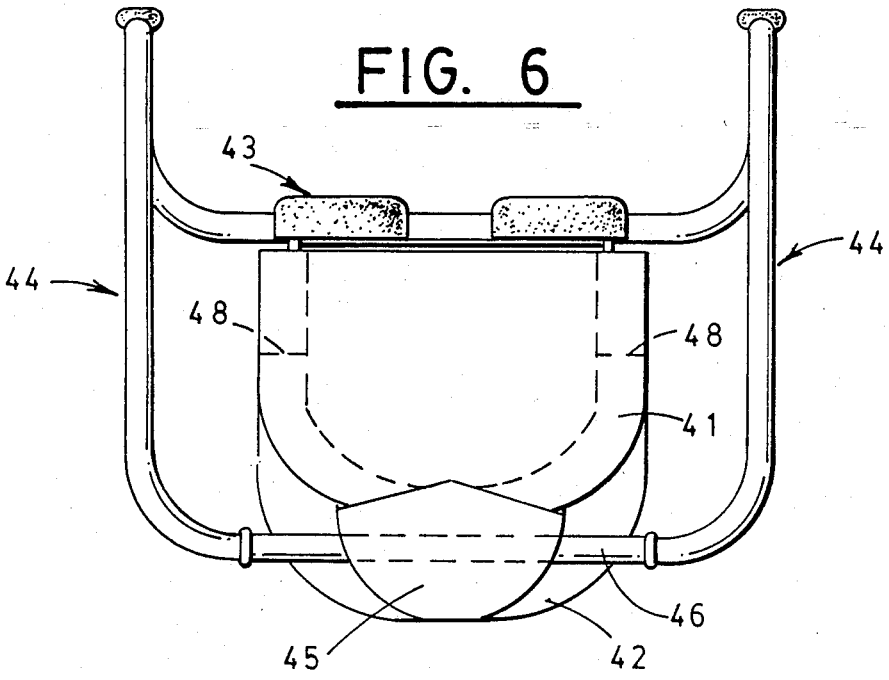
FIG. 6 is a front elevation thereof.

Turning to FIGS. 4–6 of the drawings, a wall mounted toilet assembly 40 is shown. In this version there is no water closet and the bowl 41, includes a vertical mounting base 42 for attachment to an adjacent vertical wall so that the bowl is cantilever suspended in spaced relation to an underlying floor.

A seat 43 is pivotally mounted over the upper rim of the toilet bowl in the manner of seat 16 in the FIG. 1–3 version. Two arm supports 44, 44 are shown mounted on opposite sides of bowl 41 in the same manner as previously described for the FIG. 1–3 assembly. To this latter end it will be noted that the bowl casting includes a narrowed tongue portion 45 extending beneath the bowl proper and through which a horizontal opening is formed for reception of a tubular mounting sleeve 46 that corresponds to the previously described sleeve 33 of the FIG. 1 assembly.

The opposite sides of the toilet bowl 41 are formed with two elongated recessed openings 48, one on each side thereof, which are located and serve the same purpose as openings 15 of the described assembly 10.

As in the first described version of this invention, the floor to top of seat distance in the wall mount assembly 40 preferably approximates 19–20 inches to accommodate easy transfer between toilet seat and wheelchair.

From the foregoing it is believed that those familiar with the art will readily recognize the improved advancement afforded by this invention and will appreciate that the invention as described is susceptible to modification, change and substitution of equivalent without avoiding this invention, which is intended to be unlimited by the described embodiments except as may appear in the following appended claims.

I claim:

1. A toilet assembly for the disabled, comprising:

a toilet bowl having an open top, means for supporting said bowl in an elevated use position;

a toilet seat supported over the top rim of said bowl; and said bowl having two enlarged entryways through opposite side walls thereof above the water line of residual water in said bowl to permit manual entry for perineal cleaning purposes said entryways being of sufficient size and extent to permit easy insertion of a user's hand, wrist and forearm into said bowl without the necessity of raising from said toilet seat.

2. The combination of claim 1, wherein said seat is positioned at a height from the floor such that its upper surface is substantially co-planar with the seat of a wheelchair whereby to facilitate transfer of the user between said wheelchair and toilet seat.

3. The combination of claim 1, and an arm support mounted adjacent at least one side of said toilet bowl, comprising a substantially unitary U-shaped tubular member configured to provide co-planar vertical legs interconnected by a horizontal reach; the terminal ends of said member being located adjacent the operationally lower ends of said vertical legs and disposed at right angles thereto, bracket means secured to said toilet adjacent the rearward end of said bowl for connection with one end of said tubular member, and connector means beneath said bowl and adjacent the front end thereof for rigidly anchoring the other end of said tubular member thereto.

4. The combination of claim 3 wherein said bowl is a ceramic casting, said connector means comprising a connector tube extending horizontally through said casting beneath the front end of said bowl and adapted for coaxial reception of said other end of said tubular member, and means for locking said other end to said connector tube.

5. A toilet assembly for disabled persons, comprising an open top toilet bowl, a seat mounted over the upper rim of said bowl, and means for providing a disabled user with access to the perineum without raising from said seat comprising a pair of recesses formed in the upper lateral margins on opposite sides of said bowl above the water line of the residual water in said bowl; said recesses being of sufficient size and extent to permit easy insertion of the user's hand, wrist and forearm into said bowl for perineal cleaning purposes without the necessity of raising from said toilet seat.

6. The combination of claim 5, wherein said bowl is supported by a floor engaging pedestal formed integrally therewith.

7. The combination of claim 5, wherein said bowl is cast integrally with a wall engaging base adapted to be secured to a vertical wall such that said bowl is cantilever suspended in elevated position above an underlying floor.

8. A toilet assembly for disabled persons comprising an open top toilet bowl receptive of water and means for providing a disabled person ready access to the perineum while seated over said bowl comprising, at least one recess opening laterally through an upper margin of said bowl, said recess terminating vertically above the normal residual water line in said bowl and being of sufficient size and extent to permit easy insertion of the user's hand, wrist and forearm for perineal cleaning purposes.

* * * * *

UNITED STATES PATENT AND TRADEMARK OFFICE

CERTIFICATE OF CORRECTION

PATENT NO. : 4,882,791

DATED : 11/28/89

INVENTOR(S) : Robert H. Kimes

It is certified that error appears in the above-identified patent and that said Letters Patent is hereby corrected as shown below:

Col. 2, line 57, after "joined" the "t" should be "to".

Col. 4, line 10, after "purposes" there should be a ";".

Col. 4, line 60, after "water and" there is a line missing and should be inserted "adapted to support a user over the upper rim thereof and"

Signed and Sealed this

Sixth Day of November, 1990

*Attest:*

HARRY F. MANBECK, JR.

*Attesting Officer*

*Commissioner of Patents and Trademarks*